United States Patent [19]

Kuhn et al.

[11] Patent Number: 4,996,397

[45] Date of Patent: Feb. 26, 1991

[54] SPRING-FORCE DRIVE FOR A POWER SWITCH

[75] Inventors: Max Kuhn, Unterentfelden; Rudi Schmidt, Kolliken, both of Switzerland

[73] Assignee: Sprecher Energie AG, Oberentfelden, Switzerland

[21] Appl. No.: 482,919

[22] Filed: Feb. 22, 1990

[30] Foreign Application Priority Data

Mar. 3, 1989 [CH] Switzerland ..... 00800/89

[51] Int. Cl.[5] ..... H01H 33/66

[52] U.S. Cl. ..... 200/144 B; 200/568

[58] Field of Search ..... 200/144 B, 38 C, 11 TC, 200/568

[56] References Cited

U.S. PATENT DOCUMENTS 3,204,049 8/1965 Norman ..... 200/11 TC 3,415,957 12/1968 Bleibtreu et al. ..... 200/11 TC 4,727,229 2/1988 Hodkin ..... 200/568

*Primary Examiner*—Robert S. Macon

*Attorney, Agent, or Firm*—Fleit, Jacobson, Cohn, Price, Holman & Stern

[57] ABSTRACT

Two disks per vacuum switch tube are mounted on a drive shaft, the disks having grooves running around the drive shaft and open in relation to one another. In the grooves of two of these disks, a cylindrical follower is guided, the movement of which is transmitted via a link to a swivel lever and to a movable switch contact. The drive shaft is driven, supported via a releasable support member in the switch-on and in the switch-off position, in a clockwise direction by the spiral spring in order to switch off or switch on the power switch. The follower is restrictedly guided in the grooves of the disks, whereby the position of the movable switch contact is obliged to correspond to the corresponding rotation position of the drive shaft.

12 Claims, 3 Drawing Sheets

SPRING-FORCE DRIVE FOR A POWER SWITCH

FIELD OF THE INVENTION

The present invention relates to a spring-force drive for a power switch, in particular a vacuum switch for medium-high voltage.

BACKGROUND OF THE INVENTION

A spring-force drive for a vacuum power switch for medium-high voltage is described in the Calor-Emag reports I/II/1986 on pages 9 to 12. This known spring-force drive has a drive shaft which is driven by a spiral spring for switching the power switch on and off in the same direction of rotation. On the drive shaft there is mounted, fixed in terms of rotation, a support disk with two support surfaces which cooperate in the switch-on or switch-off position of the drive shaft with a stationary, swivel-mounted support member. On the drive shaft there is also mounted, fixed in terms of rotation, one cam disk each per pole, the circumferential surface of which cam disk forms a control cam for a follower roller arranged at one end of a swivel lever. The other end of the swivel lever is connected via a contact compression spring arrangement to the movable switch contact of a vacuum switch tube. A switch-off spring also acts on the swivel lever, which switch-off spring also presses the follower roller against the circumferential surface of the cam disk. To switch on the power switch the support member releases the support plate and thus the drive shaft for a rotation through 270°, whereby the movable switch contact is brought, via the cam disk acting the terms of pressure on the follower roller and via the swivel lever, into the switch-on position. In this respect, both the contact compression spring arrangement and the switch-off spring are tensioned. In order to switch off the power switch the support member releases the support disk for a rotation of 90°. In this respect, the swivel lever and the movable switch contact are brought back into the switch-off position by the switch-off spring in accordance with the shape of the circumferential surface, the movement of the swivel lever being determined by the cam disk, against the circumferential surface of which the follower roller is pressed by the switch-off spring. In order to ensure reliable switching-off, in each case, even with soldered switch contacts, the switch-off springs are dimensioned to be considerably stronger than would be necessary to achieve the required speed of the movable switch contact. This requires that large amounts of energy have to be made available for the switching, which brings about large forces in the drive and a corresponding dimensioning.

SUMMARY OF THE INVENTION

It is thus an object of the present invention to provide for a power switch, a drive according to the generic type, which reliably drives the power switch using smaller amounts of energy than the state of the art.

Since the cam disk arrangement is connected to the reciprocating member both in terms of pushing and pulling, no separate switch-off spring is required, but rather a single spring arrangement acting on the drive shaft brings about the switching on and switching off of the power switch. Due to this, considerably smaller forces are to be transmitted. On switching off, due to corresponding shaping of the control cam, the energy emitted by the spring arrangement is converted via a first part of the switch-off angle of rotation of the drive shaft into kinetic energy by turning the drive shaft and all the parts connected fixed in terms of rotation to it. This kinetic energy and the force of the spring arrangement separates in each case even switch contacts which have been soldered to one another. By means of the connection, with pushing and pulling effect, between the cam disk arrangement and the reciprocating member, it is ensured in each case that the position of the movable switch contact corresponds to the corresponding position of the drive shaft.

A particularly simple connection, with pushing and pulling effect, between the cam disk arrangement and the reciprocating member is achieved in an exemplary embodiment.

An exemplary embodiment leads to a quiet course of movement free from play.

In multi-pole power switches it is advantageous to provide per pole, one cam disk arrangement and one reciprocating member operatively connected to the movable switch contact of the relevant pole. In this way, the forces to be transmitted per cam disk are at a minimum.

In exemplary embodiments of the spring-force drive, transverse forces acting on the reciprocating member can be avoided.

A particularly easily mountable spring-force drive is achieved by an exemplary embodiment. By the very easily achieved exchange of elements mounted on the drive shaft, the drive can be matched to various requirements. Thus, for example in an embodiment, the angles of rotation between the switching-off and the switch-on position can be freely selected by exchanging support levers.

The spring-force drive is particularly suitable for a switch arrangement as specified in the Swiss Patent Application No. 02,283/88 or in the corresponding U.S. Pat. No. 07/361,257.

BRIEF DESCRIPTION OF THE DRAWINGS

The present invention is now described in greater detail with reference to an exemplary embodiment represented in the figures, wherein in purely diagrammatic form.

DETAILED DESCRIPTION OF THE PREFERRED EMBODIMENTS

Figure 1:
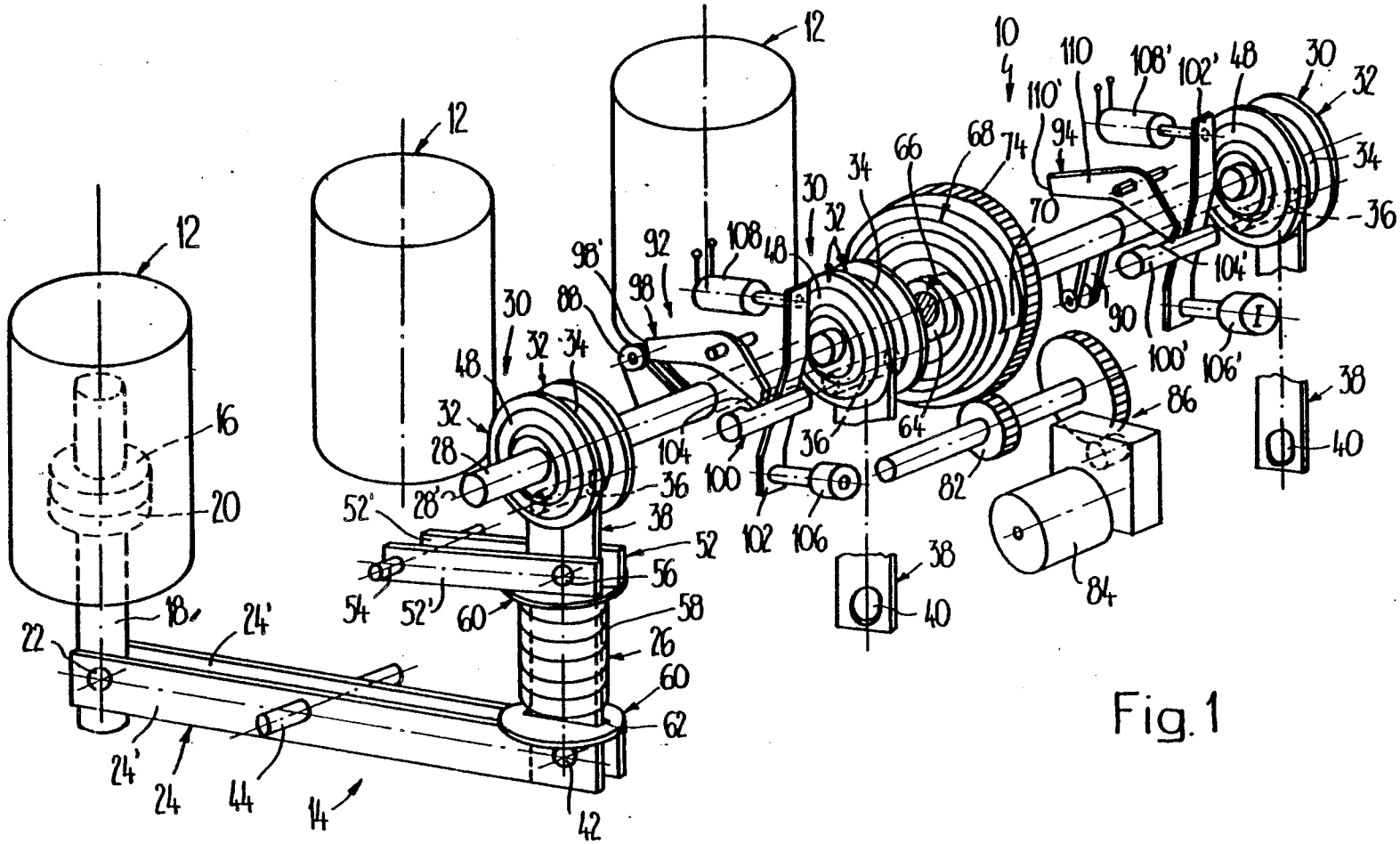
FIG. 1 shows a simplified perspective representation of a spring-force drive.

As is clear particularly from FIG. 1, the power switch for medium-high voltage has a spring drive 10 and three vacumm switch tubes 12 driven by this spring drive. The vacuum switch tubes 12 and the connecting support 14 between the respective vacuum switch tubes 12 and the drive 10 are constructed identically and for the sake of clarity in the drawings and the description are described with reference only to the pole illustrated on the far left of FIGS. 1 and 3 and in FIG. 2 as representative for the drawing and description of each vacuum switch tube.

Each vacuum switch tube 12 has a fixed switch contact 16 represented by dashes, and a movable switch contact 20 arranged at the upper end of a switch tappet 18 (FIG. 1). At the lower end region, the switch tappet 18 is connected to a double-armed swivel lever 24 in an articulated manner via a pin 22 to which is operatively connected at the other end to a cam disk arrangement 30 mounted on a drive shaft 28 of the spring-force drive 10 via a contact compression spring arrangement 26.

Figure 2:
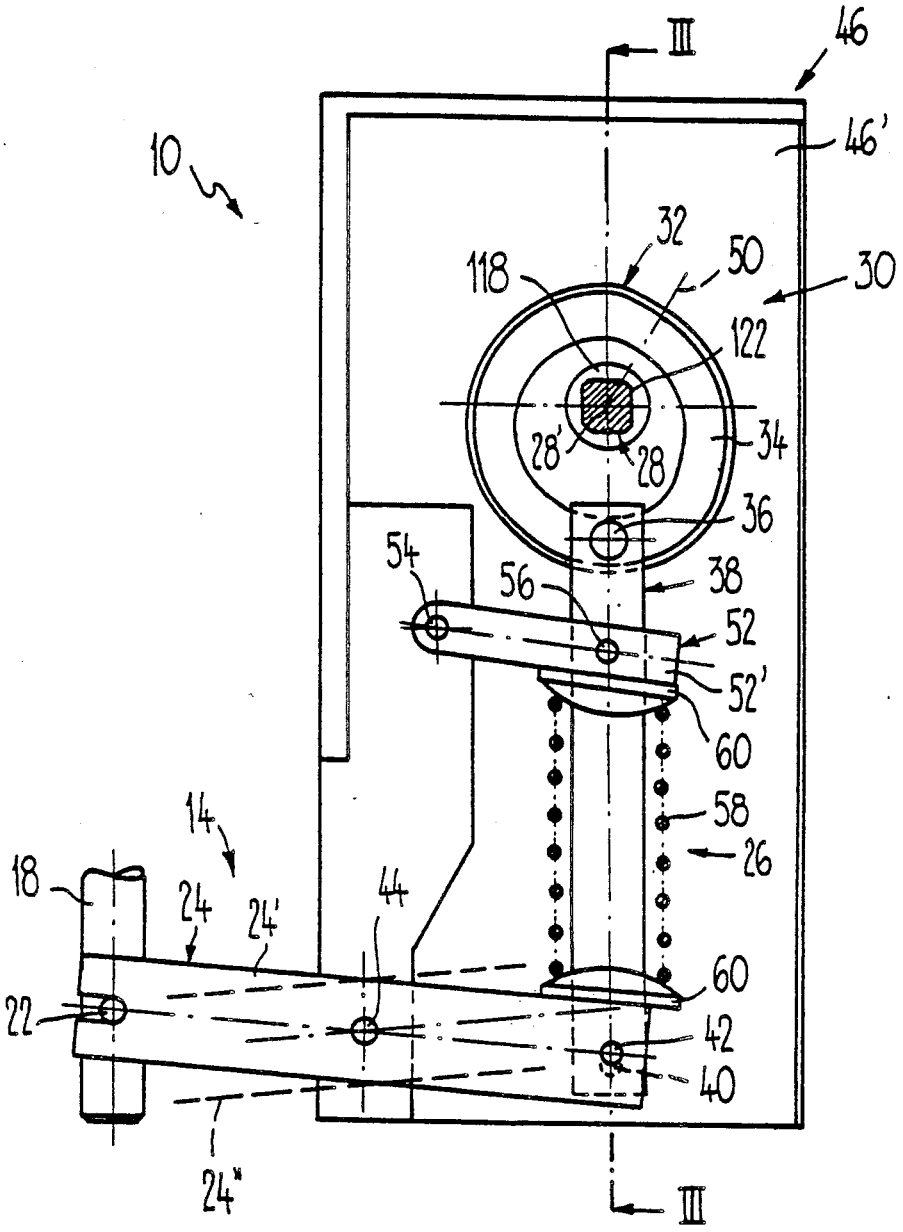
FIGS. 2 and 3 show a partially sectional side view or a longitudinal section along the line III-III in FIG. 2 of the same switch drive.
Figure 3:
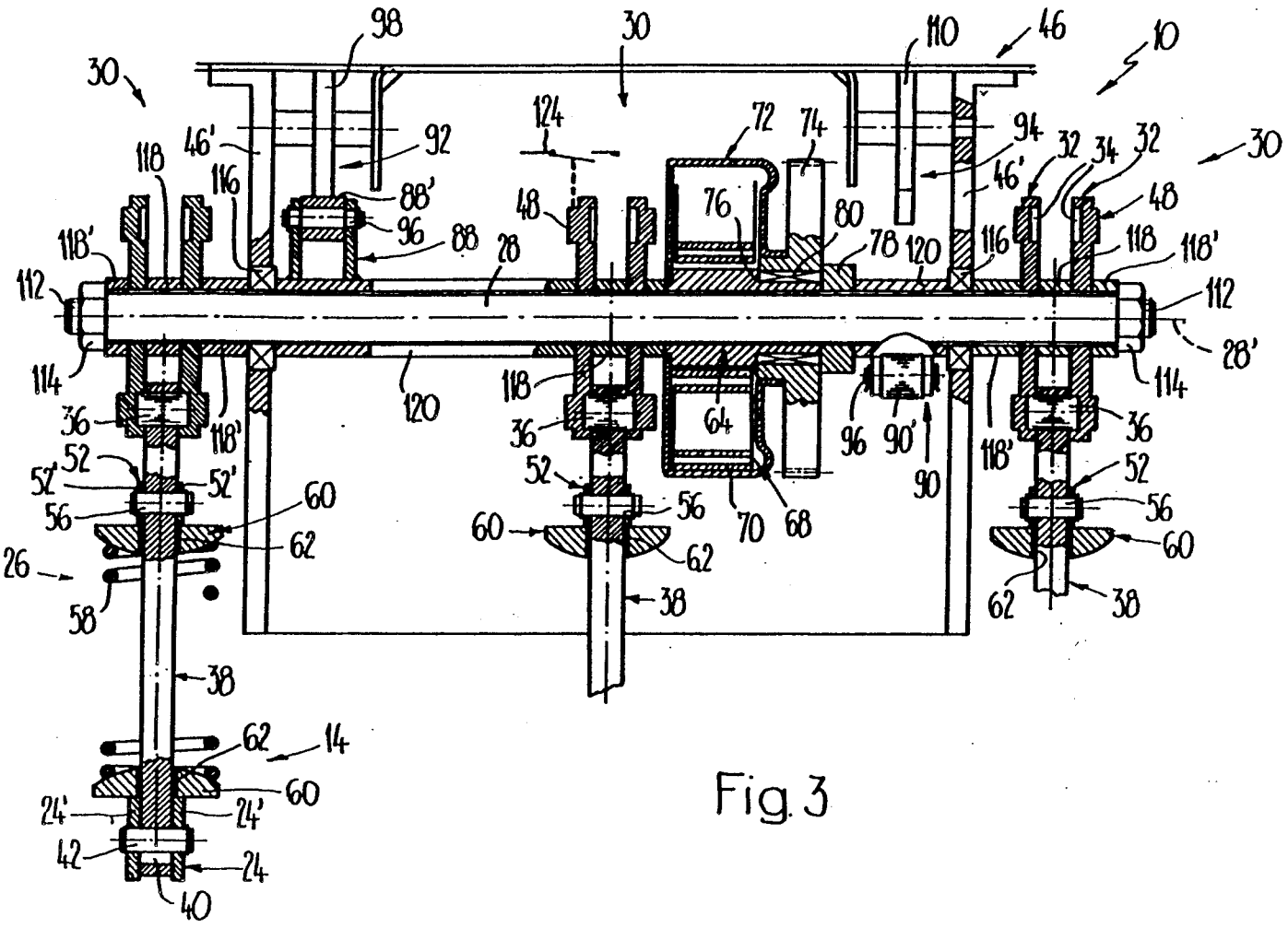

Each of the three cam disk arrangements 30 has two disks 32 at a distance from one another and constructed to be mirror-inverted, into which in each case one groove 34 which runs around the drive shaft 28 is engraved, the grooves 34 being open in the direction of the axis 28' of the drive shaft 28 and in relation to one another, see in particular FIG. 3. In the grooves 34 a cylindrical follower 36, which runs parallel to the drive shaft 28, is guided and is arranged on a link 38 running approximately in a radial direction in relation to the drive shaft 28. At the end remote from the follower 36, the link 38 has in the longitudinal direction of the link 38, an elongate passage 40, as is clear in particular in FIG. 1 in the two only partially represented links 38 for the central and right-hand switch tube 12 and in FIGS. 2 and 3. Through the passage 40, a bolt 42 which runs parallel to the follower 36 is guided and is secured to the two levers 24', at a distance from one another and running parallel to one another, of the swivel lever 24. The link 38 and the contact tappet 18 run between the two levers 24' which are swivelably mounted by means of a swivel bolt 44 to a chassis 46 (see in particular FIG. 2).

The disks 32 are punched out of a metal sheet and the grooves 34 are engraved in the same working process, projecting elevations 48 being formed in each case on the side of the disk 32 lying opposite to the groove 34. As is clear in particular from FIG. 2, the base of the grooves 34 run around the drive shaft 28 in an approximately eccentric manner, the greatest distance between the base of the groove 34 and the axis 28' of the drive shaft 28 being formed when the follower 36 is situated in the rotation position of the disks 32 as represented in the figures. The shortest distance between the axis 28' and the follower is represented in FIG. 2 by dots and dashes, and designated by line 50 when the follower 36 is located in the base of the groove 34 at the point on line 50 intersecting the groove 34 which is situated, when viewed in a counterclockwise direction, offset by approximately 150° in relation to the follower 36 as shown in FIG. 2. In the position of the disks 32, represented in the figures, the follower 36 is situated in the lower end position in which the swivel lever 24, as is represented by solid lines in FIG. 2 represented by the position 24' swivels about bolt 44 in a clockwise direction, and the movable switch contact 20 is brought into the switch-on position. If, on the other hand, the disks 32 are rotated in a clockwise direction through 150° so that the shortest distance 50 is situated between the follower 36 and the axis 28', the follower 36 is lifted into its upper end position in which the swivel lever is swiveled about bolt 44 in a counterclockwise direction in the position 24'' represented by dashes, at the same time the power switch is switched off.

Adjacent to the follower 36, the link 38 is connected in an articulated manner to a rocking arm 52, which runs approximately parallel to the swivel lever 24 and is mounted in a swivelable manner at its end remote from the link 38 linkwise to the chassis 46 by means of a shaft 54. The rocking arm 52 has two rocking levers 52' at a distance from one another and running parallel to one another, which run on both sides of the link 38 and are connected to the latter via a pin 56. Between the rocking arm 52 and the rocking lever 24 there is a contact compression spring 58, through which the link 38 runs and which is supported at both ends in each case with one universal ball joint-shaped support disk 60, which themselves rest on the rocking arm 52 or on the rocking lever 24. The support disks 60 have one slit-shaped recess 62 each for the link 38 to pass there-through.

The contact compression spring arrangement 26 operates as follows. With the follower 36 situated in the upper end position and the movable switch contact 20 correspondingly situated in switch-off position, the contact compression spring 58 presses downwards, via the lower support disk 60, the swivel lever 24 at the lower end until the bolt 42 rests against the lower end of the passage 40 through which the bolt 42 passes. If in the course of a rotation of the disks 32 in a clockwise direction and through 210°, the follower 36 is shifted towards the lower end position represented in the figures, the swivel lever 24 swivels under the pressure of the pre-tensioned contact compression spring 58 in a clockwise direction until the movable switch contact 20 rests against the fixed switch contact 16. On further downwards displacement of the follower 36, the contact compression spring 58 is further tensioned as a result of the relative movement between the now stationary swivel lever 24 and the rocking arm 52 which is entrained with the link 38, whereby the force with which the two switch contacts 16, 20 are pressed against one another is increased. In the switch-on position the bolt 42 is situated in the upper end region of the passage 40, as can be seen clearly in particular in FIGS. 2 and 3.

On the drive shaft 28 there is mounted, also fixed in terms of rotation, a spring hub 64 on which the inner end 66 of a spiral spring 68 is secured. The outer end 70 of the spiral spring 68 is connected to a spring cage 72 which embrances the spiral spring 68 in a boxlike manner and is connected, fixed in terms of rotation, to a gearwheel 74 and which gearwheel and spring cage are mounted in a freely rotating manner on the spring hub 64. The spring hub 64 has in the region of the spiral spring 68, viewed in the radial direction, a thicker wall than in the section of the spring hub, viewed in the radial direction, bordering on the gearwheel 74. Between the shoulder 76 of the spring hub 64 formed of a reduced radial thickness, and a sheath 78 located adjacent to the shoulder 76 on the drive shaft 28 there is situated a roller bearing 80 for the gearwheel 70. The roller bearing 80 is held in an indisplaceable manner in the axial direction by means of the shoulder 76 and the sheath 78.

The gearwheel 74 mates with the drive wheel 82 of a reduction gear 86 (FIG. 1) driven by means of an electric motor 84. The rotation of the spring cage 72 opposite to the lift direction of the spiral spring 68 is prevented by a free wheel (not represented) or by a return prohibitor which acts on a shaft of the reduction gear 86.

On the drive shaft 28, there are mounted, also fixed in terms of rotation, two single-armed double levers 88, 90 arranged displaced in relation to one another, which each operate with a support member 92 or 94. At the free end of each double lever 88, 90 a support roller 88' or 90' is held by means of a bolt 96. In the switch-on position represented in the figures, the support roller 88' rests counter to the force of the spiral 68 on the end face 98' of a double-armed support lever 98, mounted in a swivelable manner on the chassis 46, of the support member 92. The end face 98' is inclined in relation to the support roller 88' in such a way that the support lever 98 is subject to a force acting in a clockwise direction, the support lever 98 being secured against turning in the switch-on position at its end opposite to the end face 98' by means of a support shaft 100. The support shaft 100 is also mounted in a swivelable manner to the chassis 46 and connected, fixed in terms of rotation, to a two-armed actuation lever 102. The support shaft 100 has in the region of the support lever 98 a segmental milled flat 104, through which the support lever 98 can swivel, on the swiveling of the support shaft 100, in a clockwise direction by hand by means of a switch-off key 106 or electrically by means of a switch-off magnet 108. In this way, the drive shaft 28 is released and the latter can rotate in a clockwise direction under the influence of the spiral spring 68 until the support roller 90' of the double lever 90 comes to rest at the corresponding end face 110' of the support lever 110 of the support member 94. The support member 94 is constructed exactly identically to the support member 92 and is thus not described in more detail. The support lever 110 is also supported on a support shaft 100' which has a corresponding milled flat 104' through which, on the rotating of the support shaft 110 in a clockwise direction, the support lever 100 can swivel. The support shaft 100' can also be swiveled in a clockwise direction via a double-armed actuation lever 102' be means of a switch-on key 106' by hand or electrically via a switch-on magnet 108'.

The drive shaft 28 has an essentially square cross-section (FIG. 2) and has a thread 112 at each of its two ends (FIG. 3), on which thread in each case, one nut 114 is screwed. The chassis 46 has two end shields 46' spaced at a distance from one another and running parallel to one another, through which end shields the drive shaft 28 is guided and on which the drive shaft 28 is freely rotatably mounted by means of ball bearings 116. The two disks 32 of the cam disk arrangements 30 for the two outer vacuum switch tubes 12 are mounted on the shaft on the outer side of each of the relevant end shields 46'. Between the two end shields 46', the two double levers 88, 90 are located on the drive shaft 28 and between them the two disks 32 of the cam disk arrangement 30 for the central vacuum switch tube 12 and the spring hub 64 with the spiral spring 68, the spring cage 72 and the gearwheel 74 are arranged. The disks 32 of each cam disk arrangement 30 are spaced from one another by spacing sheaths 118 (FIG. 3), and further spacing sheaths 118' are provided between the two outer cam disk arrangements 30 and the relevant ball bearing 116 or the relevant nut 114. The double levers 88, 90 are welded onto pipes 120, which have a free inner cross-section which corresponding to the cross-section of the drive shaft 28. Likewise, the free inner cross-section of the spring hub 64 and of the passages 122 in the disks 32 is matched to the cross-section of the drive shaft 28 in order to connect these to one another fixed in terms of rotation. By means of the two nuts 114, all the parts mounted on the drive shaft 28 are secured in the axial direction.

In the spring-force drive 10 there is also provided an auxiliary switch 124, which is only diagrammatically represented, the movable contact of which can be actuated via the relevant elevation 48 of a disk 32 by rotation of the disk 32. The auxiliary switch 124 is thus closed or opened as a function of the respective rotation position of the drive shaft 28. The auxiliary switch 124 is required for acknowledgement purposes or for electrical locking of the spring-force drive 10.

The fitting of the spring-force drive 10 is very easy. On pushing the drive shaft 28 in the axial direction, in each case the next drive elements are mounted onto the drive shaft 28 and finally the drive elements are bracked against one another by means of the nuts 114.

The spring-force drive 10 operates as follows. In the switch-on position represented in the figures, the spiral spring 68 is wound in a clockwise direction through 360° by the movement of the reduction gear 86, the gearwheel 74 and the spring cage 72 by means of the electric motor 84. The drive shaft 28 is prevented from turning with the gearwheel and spring cage by the support member 92. In order to switch off the power switch, the support shaft 100 is swiveled in a clockwise direction by hand by actuating the switch-off key 106 or electrically by activating the switch-off relay 108 in a clockwise direction. The support shaft 100 releases the support lever 98 which, as a result of the pressure of the support roller 88', swivels in a clockwise direction through the milled flat 104. In this way, the drive shaft 28 which rotates in a clockwise direction through 150° under the expansion force of the spiral spring 68 until the support roller 90' of the double lever 90 comes to rest on the support lever 110 is released. As can be seen in particular from FIG. 2, during this rotary movement of the drive shaft 28 the follower 36 is pulled upwards into the groove 34 into the upper end position. This movement is transmitted via the link 38, the swivel lever 24 and the swivel tappet 18 to the movable switch contact 20 which is pushed into the switch-off position. However, before the switch lever 24 is entrained in the switch-off direction by the link 38, the contact compression spring 58 is released until the bolt 42 rests against the lower end of the passage 40. In the area between the beginning of the rotation of the drive shaft 28 and the entrainment of the swivel lever 24, the energy released by the spiral spring 68 and the contact compression spring 58 is coverted into kinetic energy which, if required, serves for releasing from each other switch contacts 16, 20 which have been soldered to one another. Under the force of the spiral spring 68 the movable switch contacts 20 are transferred into the switch-off position. Now, in order to switch on the power switch the support shaft 100' is swiveled in a clockwise direction either by hand by actuating the switch-on key 106' or electrically by activating the switch-on relay 108'. In this way, in a corresponding way the support lever 110 and thus the double lever 90 are released. As a result of the energy still stored in the spiral spring 68, the drive shaft 28 rotates through 210° until, in turn, the support roller 80' of the double lever 88 strikes against the support lever 98 of the support member 92. During this swich-on rotation through 210°, the follower 36 is transferred from the upper end position into the lower end position shown in the figures and the switch is transferred into the switch-on position. As soon as the two switch contacts 16, 20 rest against one another, the contact compression spring 58 is tensioned. As a result of the small incline of the grooves 34 in the region of the shortest distance 50, a part of the energy to be released by the spiral spring 68 is initially converted into kinetic energy in order to reach the desired stroke-time characteristic of the movable switch contact 20. In the switch-on position of the drive shaft 28, the spiral spring 68 is now in turn pulled upwards through 360°.

In order to ensure rapid switching on again and subsequent switching off again, the spiral spring 68 is pretensioned to such an extent that with the spiral spring 68 fully pulled up, the stored energy is sufficient for switching off, switching on again and switching off again, the spring cage 72 being driven again through 360° each time as soon as the switch-on position is reached.

The follower 36 is restrictedly guided in the grooves 34, by means of which a positive connection is formed between the follower 36 and the disks 32 in the direction of movement of the link 38. The position of the movable switch contact 20 is thus always obliged to correspond to the position of the drive shaft 28, corrected in each case by the differential stroke taken up by the contact compression spring 58 or the passage 40.

It is also conceivable to provide a single disk per pole, said disk then preferably having diametrically opposed grooves, one one each side. In this case, the link is constructed to be forkshaped and has on each prong a follower which is guided in the relavant groove. It is also conceivable that the respective disk only has a single groove and that the follower is prevented from slipping out of the groove by other means.

The end shields 46' can be formed on an insulating frame which at least partially embraces the vacuum switch tubes 12 and on which the vacuum switch tubes 12 can be secured. Of course, it is also conceivable that only a single cam disk arrangement is provided and the stroke of the follower 36 is transmitted via common actuation members to all vacuum switch tubes 12.

Of course, it is also conceivable that the follower is arranged on a swivel lever. It is also possible for the link to be coupled directly without a swivel lever to the contact tappet if the spring-force drive 10 and the vacuum switch tubes are in a position in relation to one another which corresponds to this. Instead of vacuum switch tubes, other interrupters can also be provided. By exchanging individual drive elements, the spring-force drive can be matched to the requirements of the most varied interrupters.

We claim:

1. A spring-force drive for a power switch, in particular a vacuum switch for medium-high voltage, said spring force drive comprising, a drive shaft, drive means for driving the drive shaft by a spring arrangement for switching on and off the power switch in the same direction of rotation of the drive shaft, support means for releasably impeding the drive shaft from turning in a switch-off and a switch-on position, at least one disk of a cam disk arrangement with a control cam mounted on the drive shaft acting with a pushing force on a reciprocating member connected operatively to at least one movable switch contact, the at least one disk being fixed in terms of rotation to move the reciprocating member to and fro between two final positions, the at least one disk having at least one groove forming the control cam running around the drive shaft and being open in the direction of the drive shaft for acting on the reciprocating member with a pulling force.

2. A spring-force drive as claimed in claim 1, wherein a follower guided in the groove is provided on the reciprocating member.

3. A spring-force drive as claimed in claim 1, wherein the reciprocating member is restrictedly guided in the groove.

4. A spring-force drive as claimed in claim 1, wherein in a multi-pole power switch one cam disk arrangement and one reciprocating member operatively connected to the movable switch contact of the relevant pole are provided per pole.

5. A spring-force drive as claimed in claim 2, wherein the cam disk arrangement has two disks at a distance from one another, the grooves of which are open towards one another, and the follower is guided in both grooves.

6. A spring-force drive as claimed in claim 1, wherein on the side of the disk opposite the groove, a switch is provided actuable by elevations formed by the groove.

7. A spring-force drive as claimed in claim 1, wherein the reciprocating member acts on the movable switch contact via a prestressed contact compression spring arrangement with a pulling force via a swivel lever.

8. A spring-force drive as claimed in claim 1, wherein the reciprocating member includes a longitudinal extension running substantially at right angles to the drive shaft, is mounted to two rocking arms as a coupling, and one of the two rocking arms being formed by a swivel lever.

9. A spring-force drive as claimed in claim 1, wherein the drive shaft has a multi-sided cross-section and all the elements connected, fixed in terms of rotation to the drive shaft, are mounted on the cross-section in a positively interlocking manner, with an intermediate connection of spacers and are held in axial direction by retaining elements.

10. A spring-force drive as claimed in claim 9, wherein two oppositely offset support levers are mounted, fixed in terms of rotation, on the drive shaft, which support levers each cooperate with one stationary support member for the releaseable securing of the drive shaft in the switch-off or switch-on position.

11. A spring-force drive as claimed in claim 9, wherein the spring arrangement has a spiral spring, an inner end of the spiral spring is connected to a spring hub mounted, fixed in terms of rotation, to the drive shaft and an outer end of the spiral spring is connected to a spring cage mounted to be freely rotatable about the drive shaft, and the spring cage is operatively connected to a return prohibitor and to a lifting member.

12. A spring-force drive as claimed in claim 1, wherein the drive shaft and drive parts are mounted on at least one shield formed on an insulating support frame of the power switch which at least partially embraces the vacuum switch tube.

* * * * *